US006305685B1

(12) United States Patent
Motosko

(10) Patent No.: US 6,305,685 B1
(45) Date of Patent: Oct. 23, 2001

(54) COMBINATION MINIATURE RACE CAR AND PINBALL GAME

(76) Inventor: Stephen J. Motosko, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 09/566,892

(22) Filed: May 8, 2000

(51) Int. Cl.[7] ..... A63F 7/02

(52) U.S. Cl. ..... 273/118 R; 273/119 R; 273/121 R; D21/313

(58) Field of Search ..... 273/118 R, 118 A, 273/119 R, 119 A, 121 R, 121 A; D21/313

(56) References Cited

U.S. PATENT DOCUMENTS

| | | | | |
|---|---|---|---|---|
| 4,287,680 | * | 9/1981 | Allen et al. | 446/192 |
| 4,334,679 | * | 6/1982 | Doyle et al. | 463/3 |
| 5,088,736 | * | 2/1992 | Chuang | 273/121 R |
| 5,280,908 | * | 1/1994 | Lu | 273/121 R |
| 5,294,172 | * | 3/1994 | Dubus | 446/227 X |
| 5,759,083 | * | 6/1998 | Polumbaum et al. | 446/435 |

FOREIGN PATENT DOCUMENTS

| | | | | |
|---|---|---|---|---|
| 2064340 | * | 6/1981 | (GB) | 273/121 R |

* cited by examiner

*Primary Examiner*—Raleigh W. Chiu
(74) *Attorney, Agent, or Firm*—Charles J. Prescott

(57) ABSTRACT

A combination toy car and a miniature pinball game. The toy car includes a miniature car body having operable support wheels and a removable top portion thereof. A miniature pinball game is operably positioned within the car body and is operably accessible for play when the top portion is removed. The pinball game, including a pinball table, are concealed when the top portion is in normal position on the car body. A simulated rear spoiler pivotally connected to a rear portion of the car body includes a viewable display scoreboard for the pinball game. The scoreboard is activated for keeping score for each game played on the pinball game when the scoreboard is pivoted from a first position in which said pinball game is inactive to a second position. A plurality of pinball game manually activated surfaces of the car body and wheels are provided which, when the pinball game is in the activated mode, cause predetermined movement of one or more elements of the pinball game.

4 Claims, 2 Drawing Sheets

COMBINATION MINIATURE RACE CAR AND PINBALL GAME

BACKGROUND OF THE INVENTION

Scope of Invention

This invention relates generally to electronic toys and games, and more particularly to a miniature toy race car in combination with a miniature pinball game.

Prior Art

A virtually limitless array of miniature cars, including those having the appearance of a race car, are well known. These miniature cars may be passive, rollable or electronically powered for movement across a surface.

Conventional pinball games are also well known in which a horizontal surface supports a variety of moveable striking members, an array of scoring targets and a separate pinball which is driven across the horizontal surface by manually activating one or more of the pinball striking members. Typically, a scoreboard is included with pinball machines so that each player may be provided with a cumulative count or score achieved during each play time period.

The present invention provides a unique combination of a miniature toy race car and a miniature pinball game housed within the car body of the race car. By removal of the removable top portion of the car body, the otherwise concealed miniature pinball game is made playably accessible. A miniature scoreboard, preferably in the form of a rear spoiler or air deflector, when pivotally moved into operative position, provides a viewable display of the ongoing and total score achieved by each player during each timed game played. Various of the striking members are selectively activated by pressing or depressing selected areas of the car body and wheels.

BRIEF SUMMARY OF THE INVENTION

This invention is directed to a combination toy car and a miniature pinball game. The toy car includes a miniature car body having support wheels and a removable top portion thereof. A miniature pinball game is operably positioned within the car body and is operably accessible for play when the top portion is removed. The pinball game, including the pinball table are concealed when the top portion is in position on the car body. A simulated rear spoiler pivotally connected to a rear portion of the car body includes a viewable display scoreboard for the pinball game. The scoreboard is activated for keeping score for each game played on the pinball game when the scoreboard is pivoted from a first position in which said pinball game is inactive to a second position. A plurality of pinball game manually activated surfaces of the car body and wheels are provided which, when the pinball game is in the activated mode, cause predetermined movement of one or more elements of the pinball game.

It is therefore an object of this invention to provide a combination miniature toy car and miniature pinball game which is revealed for use when a top portion of the car body is removed.

It is another object of this invention to provide a combination miniature toy car and miniature pinball game which includes a scoreboard attached to the car body, preferably in the form of a rear air spoiler which, when pivoted upwardly, activates the scoreboard.

In accordance with these and other objects which will become apparent hereinafter, the instant invention will now be described with reference to the accompanying drawings.

DETAILED DESCRIPTION OF THE INVENTION

Figure 1:
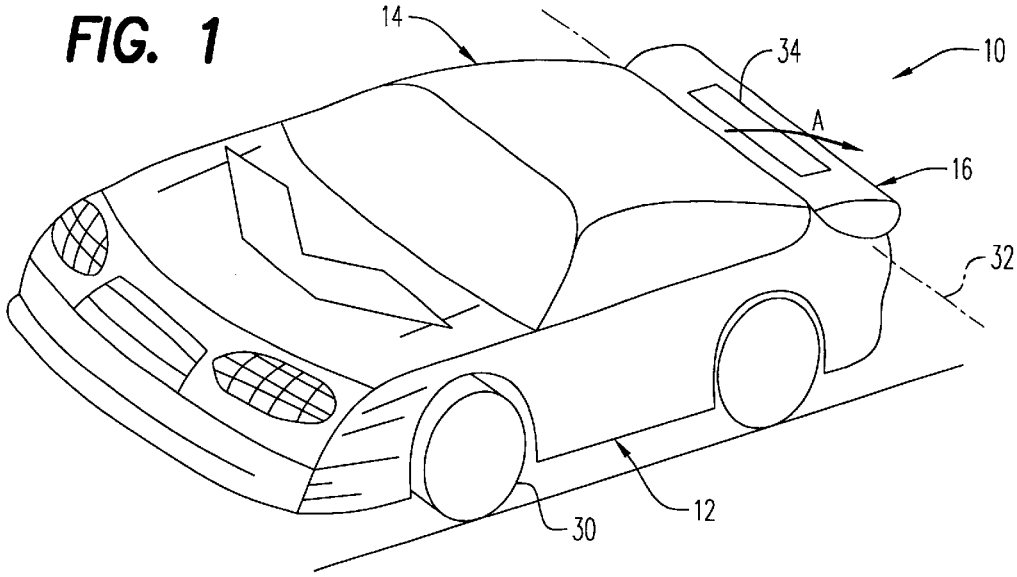
FIG. 1 is a perspective view of the invention ready for use as a toy car.
Figure 2:
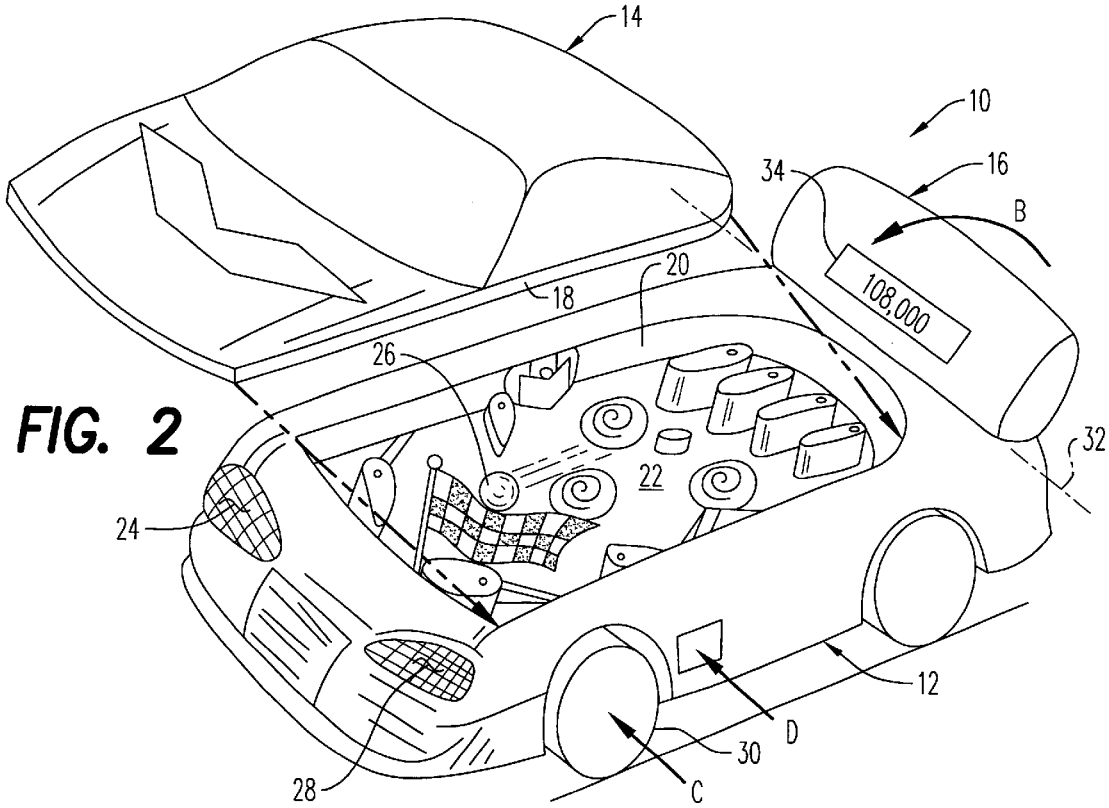
FIG. 2 is an exploded view of the invention, the top portion of the car body shown removed to reveal the miniature pinball game therebelow and with the spoiler in an upward position thus activating the scoreboard therein.

Referring now to the drawings, one embodiment of the invention is shown generally at numeral 10 in both FIGS. 1 and 2. In FIG. 1, the combination miniature toy car and miniature pinball game 10 is shown in the toy car use configuration. In FIG. 2, the invention 10 is in its pinball game operational mode.

The invention 10 includes a car body 12 having preferably the appearance of a NASCAR race car. Operable wheels 30 support the car body 12 atop a horizontal surface. A separable top portion is shown at 14 in its normal position in FIG. 1 to complete the appearance of the toy car. The simulated rear air spoiler 16 is pivotally connected to the rear of the car body 12 about a transverse axis 32. A scoreboard panel 34 is contained on the upper surface of the spoiler 16; however, when the spoiler 16 is pivoted about axis 34 in the direction of arrow A downwardly, the scoreboard 34 is inactive.

In FIG. 2, the top portion 14 is shown removed to reveal a miniature pinball game shown generally at 22. The miniature pinball game 22 includes a strikeable free rolling pinball 26 and a usual array of strikers, bumpers and channels arranged as desired to complete the pinball game structure.

When the spoiler 16 is pivoted in the direction of arrow B upwardly about pivotal axis 32 in the direction of arrow B in FIG. 2, the pinball game scoreboard 34 is activated to maintain a running score achieved by each player during each pinball game played.

To activate one or more of the moveable strikers within the miniature pinball game 22, one or the other of the headlights 24 or 28 may be depressed. Manual pressure applied to one or the other of the headlights or other parts of the toy body 12 will, by either conventional mechanical means or electronic finger touch means, effect the desired striker activation. Additionally, one or more of the wheels 30 may be inwardly depressed in the direction of arrow C to activate additional striker members as desired, depending on the overall layout of the miniature pinball game 22 when designed. Although the scoreboard 34 location as shown is within the pivotally connected spoiler 16 as above described, other scoreboard locations on the car body such as at the front grill, the rear end of the car body 12 or the rear surface of the spoiler 16 may be utilized.

Figure 3:
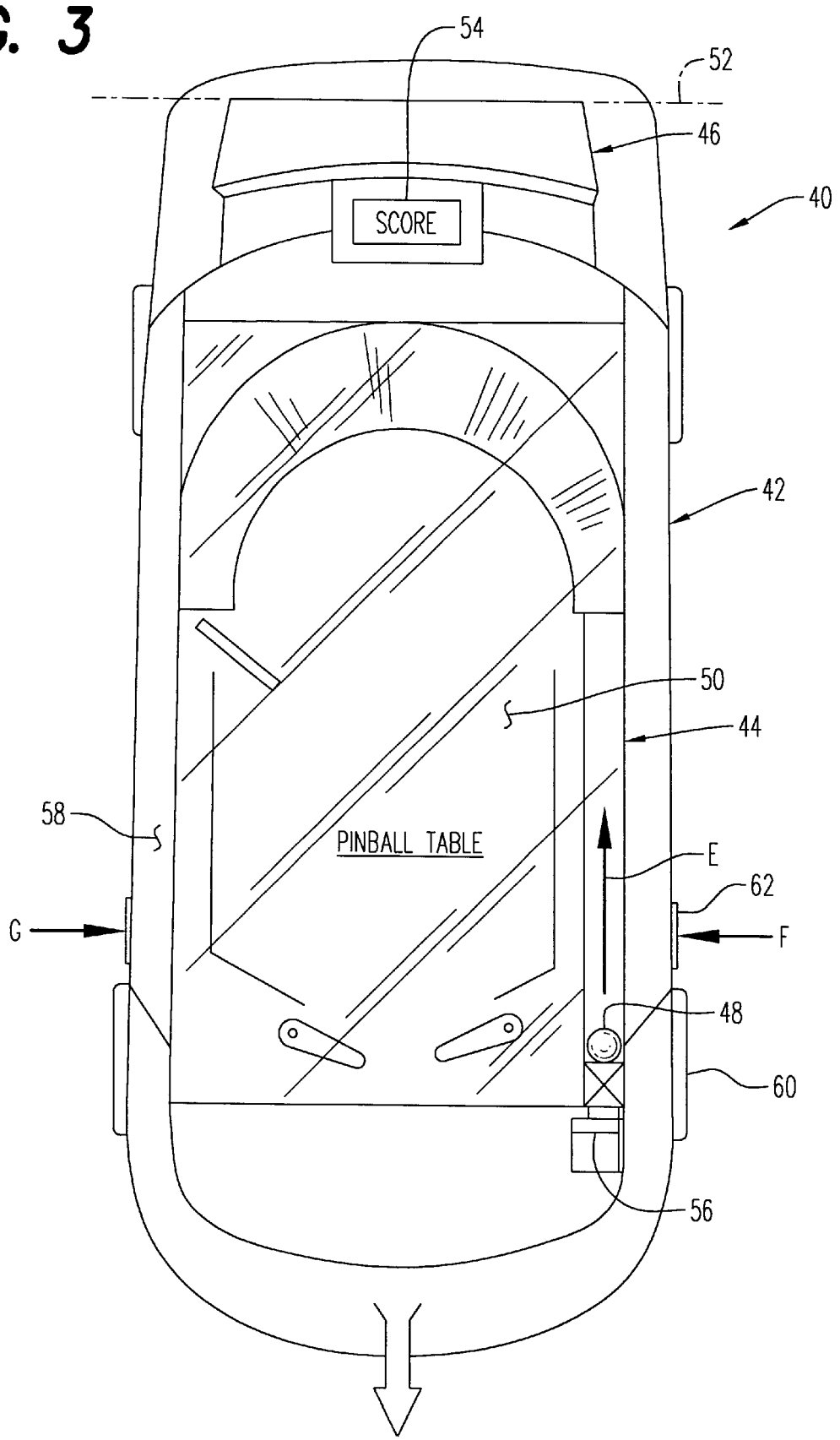
FIG. 3 is a top plan view of the preferred embodiment of the invention with the top portion of the car body removed and not shown for clarity and with the rear deck of the car body in its pivoted upward in-use position activating the scoreboard.

Referring now to FIG. 3, the preferred embodiment of the invention is there shown generally at numeral 40. This embodiment 40 includes a car body 42, again, having the appearance of a miniature race car. Operable wheels 60 support the car body 42 atop a horizontal or inclined surface as desired. A separate top portion (not shown) rests atop flat surface 58 when in place to complete the appearance of the toy car.

A miniature pinball game, including a pinball table 44 are revealed when the separable top portion (not shown) is removed. The pinball table 44 may be somewhat altered from that shown in FIG. 2 but, again, is generally conventional in nature. This preferred embodiment of the pinball table 44 includes a spring-actuated striker 56 which strikes a pinball 48 propelling it along a support ramp in the direction of arrow E. Once the pinball 48 is propelled and begins to move about the pinball table, each of the bumpers shown are separately manually activated by depressing one or both body panels 62 in the direction of arrows F and G.

The entire pinball table 44 is enclosed by a transparent panel 50 so that the moveable components of the pinball game 44, including the pinball 48, are protected and retained therein. A separate rear deck panel assembly 46 is manually pivotable upward about axis 52 to reveal a scoreboard 54 for the pinball game 44. In this configuration, with each player standing at the front of the toy car, the scoreboard 54 is easily viewable.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A combination toy car and a miniature pinball game comprising:

a miniature car body including support wheels and a removable top portion of said car body;

a miniature pinball game operably positioned within said car body and operably accessible for play when said top portion is removed, said pinball game concealed when said top portion is in position on said car body;

a simulated rear spoiler pivotally connected to a rear portion of said car body, said spoiler including a viewable display scoreboard for said pinball game, said scoreboard placed in an active mode for keeping score for each game played on said pinball game when said scoreboard is pivoted from a first position in which said pinball game is inactive to a second position in which said pinball game is active;

a plurality of manually activated surfaces of said car body and wheels which, when said pinball game is in the activated mode, cause a predetermined movement of one or more pinball striking elements of said pinball game.

2. A combination toy car and a miniature pinball game comprising:

a miniature car body including support wheels and a top portion of said car body which is removable;

a miniature pinball game operably positioned within said car body and operably accessible for play when said top portion is removed, said pinball game otherwise concealed when said top portion is in normal position on said car body;

a scoreboard pivotally connected to a rear portion of said car body and moveable between a first and a second position, said scoreboard including a viewable scoring display for said pinball game, said scoreboard placed into an active mode for keeping score for each game played on said pinball game when said scoreboard is pivoted from said first position in which said pinball game is inactive to said second position in which said pinball game is active;

a plurality of pinball game manually activated surfaces of said car body and wheels which, when said pinball game is in the activated mode, causing predetermined movement of one or more elements of said pinball game.

3. A combination toy car and a miniature pinball game comprising:

a miniature car body including support wheels and a removable top portion of said car body;

a miniature pinball game operably positioned within said car body and operably accessible for play when said top portion is removed, said pinball game concealed when said top portion is in position on said car body;

a scoreboard attached to said car body including a viewable display scoreboard for said pinball game, said scoreboard placed in an active mode for keeping score for each game played on said pinball game when said top portion is removed;

a plurality of manually activated surfaces or buttons on said car body and wheels which, when said pinball game is in the activated mode, cause a predetermined movement of one or more pinball striking elements of said pinball game.

4. A combination toy car and a miniature pinball game as set forth in claim 3, further comprising:

a protective transparent cover connected and extending over and in proximity to a flat pinball table of the pinball game.

* * * * *